US008164523B2

(12) United States Patent
Betts-LaCroix

(10) Patent No.: US 8,164,523 B2
(45) Date of Patent: Apr. 24, 2012

(54) COMPACT ANTENNA

(75) Inventor: Jonathan Betts-LaCroix, San Mateo, CA (US)

(73) Assignee: Google Inc., Mountain View, CA (US)

( * ) Notice: Subject to any disclaimer, the term of this patent is extended or adjusted under 35 U.S.C. 154(b) by 0 days.

(21) Appl. No.: 12/436,428

(22) Filed: May 6, 2009

(65) Prior Publication Data

US 2011/0057841 A1 Mar. 10, 2011

Related U.S. Application Data

(60) Provisional application No. 61/050,642, filed on May 6, 2008.

(51) Int. Cl.
*H01Q 1/38* (2006.01)

(52) U.S. Cl. ..... 343/700 MS; 343/702

(58) Field of Classification Search ..... 343/700 MS, 343/702, 829, 846
See application file for complete search history.

(56) References Cited

U.S. PATENT DOCUMENTS

| | | | | |
|---|---|---|---|---|
| 5,973,651 | A * | 10/1999 | Suesada et al. | 343/752 |
| 6,476,767 | B2 * | 11/2002 | Aoyama et al. | 343/700 MS |
| 6,587,076 | B2 * | 7/2003 | Fujii et al. | 342/372 |
| 6,809,687 | B2 * | 10/2004 | Yuanzhu | 343/700 MS |
| 7,382,319 | B2 * | 6/2008 | Kawahata et al. | 343/700 MS |

* cited by examiner

*Primary Examiner* — Tho G Phan
(74) *Attorney, Agent, or Firm* — Morris & Kamlay LLP

(57) ABSTRACT

An antenna 1 for a hand held or small radio communication device such as a cellular radio handset, laptop computer or hand held computer, or GPS device. The antenna has a resonating element 12 over a ceramic material 14, comprised of a high dielectric ceramic, such as barium strontium titanate, for example. The ceramic 14 is in contact with a ground plane 15 such as a grounded metal plate or grounded thin film that is formed on a substrate, such as an FR4 PCB substrate. The ceramic 14 is biased by a voltage source applied through an electrode plate 13 that is connected to a high voltage source 16 with respect to ground plate 15. The voltage applied through the conductor or electrode 13 is controlled to provide a predetermined bias voltage that changes the electrostatic field of the ceramic 14.

13 Claims, 2 Drawing Sheets

COMPACT ANTENNA

CROSS REFERENCES TO RELATED APPLICATIONS

This application claims the benefit of U.S. Provisional Application No. 61/050,642 filed May 6, 2008, the entire disclosure of which is incorporated herein by reference.

FIELD OF THE INVENTION

The invention relates to high dielectric antenna technology.

BACKGROUND OF THE INVENTION

Dielectrics are used in the design of antennas for small electrical devices, such as hand held devices, which use radio communication. For example, cell phones, laptop and hand held computers, as well as GPS devices use antennas that are designed to be incorporated within such devices within a small volume while providing radio communication in the Mhz and Ghz ranges. Examples of antennas for cellular phones are dielectric resonator antennas (DRAs) and high dielectric antennas (HDAs).

SUMMARY OF THE INVENTION

One problem with dielectric resonator antennas DRAs and high dielectric antennas HDAs are that they tend to have limited band width. Increasing the bandwidth for devices using these antennas requires additional circuitry and/or increasing the size, foot print or volume required of the antenna.

DETAILED DESCRIPTION OF THE PREFERRED EMBODIMENTS

Figure 2:
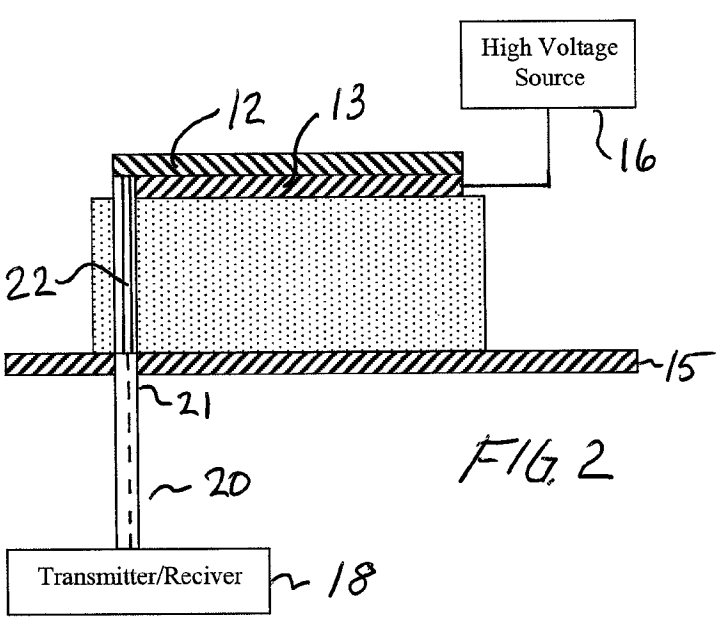
FIG. 2 shows a partial cross-sectional view of the antenna shown in FIG. 1 taken along lines 2-2.
Figure 1:
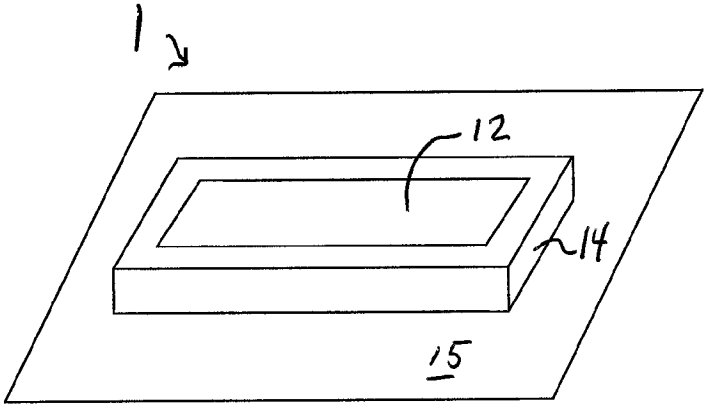
FIG. 1 shows a perspective view of a planar ceramic dielectric antenna.

FIG. 1 shows a perspective view of an antenna 1 for a hand held or small radio communication device such as a cellular radio handset, laptop computer or hand held computer, or GPS device. The antenna has a resonating element 12 over a ceramic material 14, comprised of a high dielectric ceramic, such as barium strontium titanate, for example. The ceramic 14 is in contact with a ground plane 15 such as a grounded metal plate or grounded thin film that is formed on a not shown substrate, such as an FR4 PCB substrate The ceramic 14 is biased by a voltage source applied through an electrode plate 13 that is connected to a high voltage source 16 with respect to ground plate 15, as shown in FIG. 2. The voltage applied through the conductor or electrode 13 is controlled to provide a predetermined bias voltage that changes the electrostatic field of the ceramic 14. As shown in the embodiment of the antenna of FIG. 2, the resonator element 12 is a metal plate or thin film overlying and/or formed on the electrode 13. The films are shown to be separate and they may be in electrical contact with each other. However, the electrode 13 can be physically part of the resonating element 12 as contemplated by other embodiments of the invention. The metal electrodes, plates and films can be composed of a conductive metals such as copper, or silver, etc. that are either plated or laminated onto the ceramic.

The transmitter/receiver of radio 18 is connected to the radiating or resonating element 12 through a coaxial cable 20. Coaxial cable 20 has an outer sheath 21 that is connected to the ground plate 15 and an inner conductor 22 that is connected to the resonating member 12 at one end of the resonating member.

By applying a voltage, such as a DC voltage, with high voltage source 16 to the electrode 13, an electrostatic field is created between the electrode 13 and ground plane 15. The application of the electrostatic field changes the permittivity of the material which may be, for example, BST comprised of barium strontium titanate. By changing the permittivity of the ceramic 14, the resonant frequency of the resonating member 12 is changed, to vary the center frequency of the bandwidth for the antenna over a wider range of frequencies than would be provided if the electrostatic field remained unchanged. Further, by changing the bias voltage applied, on demand, the antenna can be made to resonate at center frequencies that change as needed in relation to changes in the communication mode (data/voice), frequency band, or changes in a transmitting/receiving cell and/or channel for cellular communication for a mobile device. The antenna is thereby useful for devices that perform radio transmission/reception over a wide variety of middle frequencies that can be changed, even during communication. The bias voltage required can be in the range of tens of volts for thinner dielectrics, to thousands of volts for thicker ones.

Figure 3:
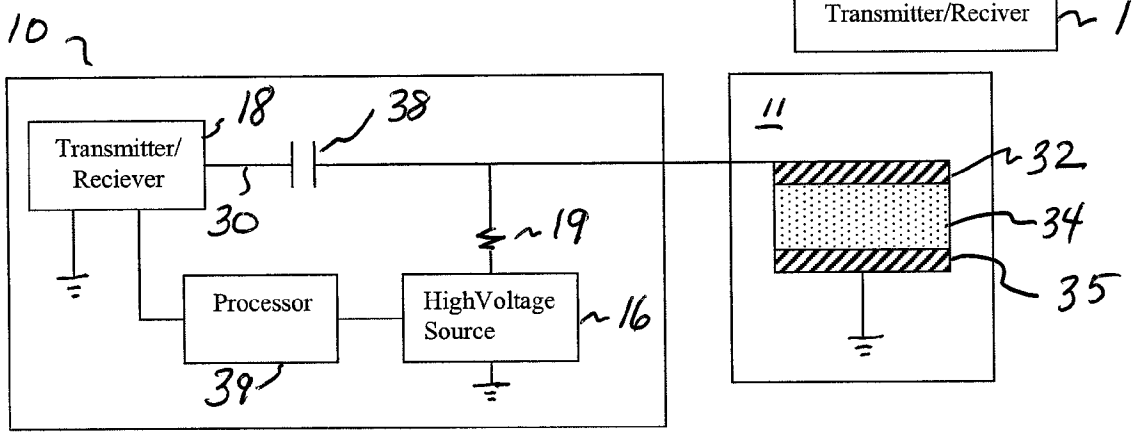
FIG. 3 is a component diagram of an antenna component for use in radio communications according to a second embodiment of the invention.

FIG. 3 shows a detailed (second) embodiment of the invention in which a hand held device 10, such as a cell phone, PDA, Laptop or GPS, for example, is provided with the antenna. The device has a transmitter/receiver 18 and a signal processor and control processor unit 39 that controls operations common to such devices. Further, the processor provides control of the voltage applied to the ceramic 34, which is disposed between a ground plate 35 and an electrode or metal film or plate 32 that functions as a resonating element and also as an electrode (such as the electrode 13 of FIG. 2) for applying the electrostatic field from a high voltage source 16.

As shown in FIG. 3, and as also understood with respect to FIG. 2, the high voltage source 16 is applied through a resistance 19 used in the control of the applied DC voltage. Also, the transmitter/receiver 18 provides an output signal 30 that is transmitted through a capacitor 38 to the resonating member 22 of the antenna 11 of this embodiment. The operation of applying a bias voltage between electrode plate 32 and ground plate 35 with the high voltage source is the same as in the embodiment of FIG. 2. Further, in FIG. 3, the transmitter applies the signal 30 to the same element which is used for applying the biasing voltage to the ceramic 34. The ceramic 34 may be of the same material as that of ceramic 14.

It is understood that the high voltage source 16 applies a voltage according to a calibration or otherwise pre-set voltages that are determined according to testing to enable the antenna element 32 to resonate at pre-determined frequencies, such as standard middle frequencies that are standard for radio communication for bandwidths in the MHz and GHz ranges. That is, the center frequency of the resonance of the resonating member 42 (12 and/or 32) is changed to enable changes in the radio operation of the device in which the antenna is incorporated. The needed voltage can also be finetuned by a feedback loop in which the capacitance with respect to a separate electrode (not shown; disposed beside the resonating member on the ceramic) and the grounding plate is measured and output as a signal and used as a proxy for the permittivity of the ceramic 34 under the resonating member 32, and thus of the resonant frequency of the antenna 11. For example, the output signal can be fed back to processor 39, used in the control of the high voltage source 16, to be used as a feedback signal for fine tuning the control of the bias voltage applied to the ceramic 34.

Figure 4:
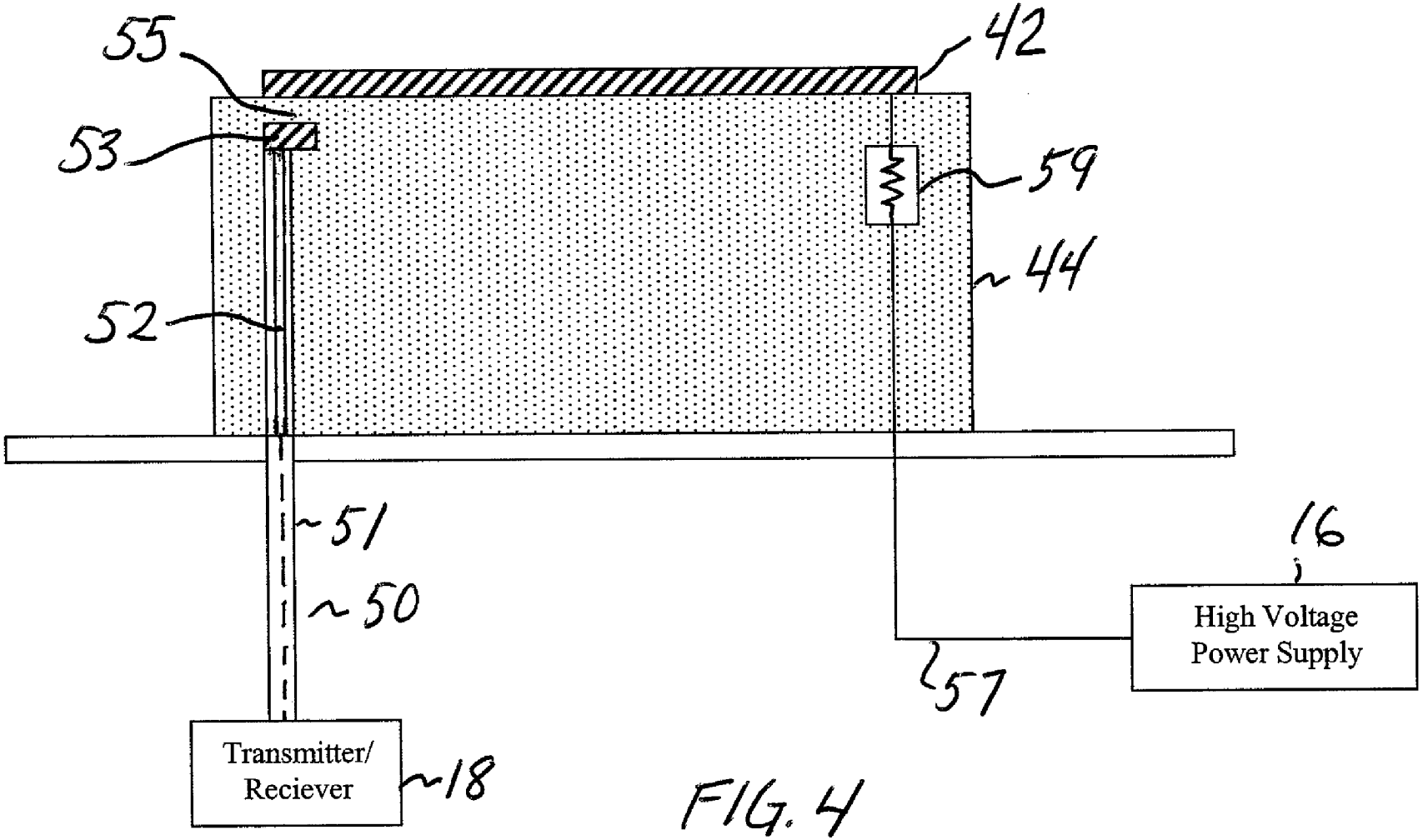
FIG. 4 is a partial cross-section similar to FIG. 2 showing a third embodiment of the invention.

In FIG. 4, another embodiment of the antenna of the invention is shown. In particular, FIG. 4 shows a ceramic 44 that has an electrode or metal film or plate 42 on one surface of the ceramic and a ground plate or plane 45 that is on the other side of the ceramic so that a bias is applied to the material for applying changes to the electrostatic field to the ceramic. Further, the transmitter/receiver 18 is connected by way of a coaxial cable 50 having an outer sheath 51 connected to the ground plane 45 and an inner conductor 52 connected to a terminal contact or pad 53. Pad 53 is spaced apart from the electrode 42 by an interposed area of the ceramic material 55 such that a capacitance is created. This capacitance is used to supplement or in place of the of capacitor 38 that is shown in the embodiment of FIG. 3.

With respect to FIG. 4, the high voltage supply 16 is provided through a conductor 57 that has a resistor 59. The resistor may be incorporated within ceramic material 44 or on the outside of the ceramic material, alternatively. The change in resonance frequency and operation of the antenna shown in FIG. 4 is accomplished in the same manner as in the first and second embodiments. That is, the high voltage power supply 16 applies a voltage that changes the electrostatic field of the ceramic 44, which results in a change of the resonance of the antenna.

In all of the figures, where the same reference number is used, the same component is intended to be shown and duplicative description of the component is therefore unnecessary.

While preferred embodiments have been set forth with specific details, further embodiments, modifications and variations are contemplated according to the broader aspects of the present invention.

I claim:

1. An antenna for a communication device comprising:

a resonating element over a ceramic material, the ceramic material comprised of a high dielectric ceramic, wherein the ceramic material is in contact with a ground plane formed on a substrate;

said ceramic material being biased by a voltage source applied through an electrode plate positioned between the resonating element and the ceramic material that is connected to a high voltage source with respect to a ground plate, the voltage applied through the electrode plate is controlled to provide a variable predetermined bias voltage that changes the electrostatic field of the ceramic as needed in response to a communication mode of the communication device.

2. The antenna of claim 1, further comprising:

a cable having an outer sheath connected to the ground plane and an inner conductor connected to the resonating element.

3. The antenna of claim 1, wherein the communication mode is at least one of data or voice communication.

4. An antenna for a communication device comprising:

a ceramic material, the ceramic material having a permittivity value;

a ground plane beneath and contacting the ceramic material;

an electrode plate above and contacting the ceramic material;

a conductive pad contacting the ceramic material and located adjacent to the electrode plate;

a high voltage supply conductor connected to the electrode plate, the high voltage supply conductor connectable to a high supply voltage source, wherein the permittivity value of the ceramic material changes when a high supply voltage signal is applied to the electrode plate; and a cable connected to the conductive pad in the ceramic material, and connectable to a transmitter-receiver in the communication device, wherein the conductive pad and the electrode plate form a capacitance through which transmission signals pass.

5. The antenna of claim 4, wherein the cable is a coaxial cable having an outer sheath connected to the ground plane and an inner conductor connected to the conductive pad.

6. A communication device comprising:

a transmitter-receiver having a first connection and an output;

a processor connected to the first connection;

a high voltage source connected to the processor and responsive to control signals from the processor;

a capacitance device connected to the transmitter-receiver output and to the high voltage source at a common node; and an antenna connected to the common node, the antenna comprising:

a ceramic material having a permittivity value;

an electrode plate that receives an output signal from the transmitter-receiver and a high voltage signal from the high voltage source, wherein the high voltage signal changes the permittivity value of the ceramic material; and a ground plate.

7. The device of claim 6, wherein the processor controls the high supply voltage to change the high voltage signal value based on the communication mode of the communication device.

8. The device of claim 7, wherein the communication mode is at least one of data or voice communication.

9. The device of claim 6, wherein the processor controls the high supply voltage to change the high voltage signal value based on the frequency band of the communication device.

10. The device of claim 6, wherein the processor controls the high supply voltage to change the high voltage signal value based on the channel for cellular communication of the communication device.

11. The device of claim 6, wherein the processor controls the high supply voltage to change the high voltage signal value based on changes in the transmitting or receiving cell for cellular communication of the communication device.

12. The device of claim 6, wherein the ceramic material of the antenna further comprises:

a conductive pad contacting the ceramic material and located adjacent to the electrode plate to provide a capacitance between the electrode plate and the transmitter-receiver.

13. The device of claim 12, wherein the antenna further comprises:

a cable connected to the conductive pad in the ceramic material, and connectable to a transmitter-receiver in the communication device, wherein the conductive pad and the electrode plate form a capacitance through which transmission signals pass.

* * * * *